US008522391B1

(12) United States Patent
Safieh

(10) Patent No.: US 8,522,391 B1
(45) Date of Patent: Sep. 3, 2013

(54) INFANT ORAL HYGIENE DEVICE

(76) Inventor: Eric Safieh, Toronto (CA)

( * ) Notice: Subject to any disclaimer, the term of this patent is extended or adjusted under 35 U.S.C. 154(b) by 7 days.

(21) Appl. No.: 13/421,251

(22) Filed: Mar. 15, 2012

(51) Int. Cl.
*A46B 5/04* (2006.01)
*A46B 9/04* (2006.01)

(52) U.S. Cl.
USPC ..... 15/227; 15/110; 15/167.1

(58) Field of Classification Search
USPC ..... 15/110, 167.1, 227; 132/308, 309; 433/141; 601/137, 138, 139
See application file for complete search history.

(56) References Cited

U.S. PATENT DOCUMENTS

| | | | | |
|---|---|---|---|---|
| 4,251,897 | A | 2/1981 | Alam | |
| 4,617,694 | A * | 10/1986 | Bori | 15/167.1 |
| 4,621,387 | A * | 11/1986 | Noser | 15/167.1 |
| 4,628,949 | A * | 12/1986 | Mas et al. | 132/308 |
| D313,317 | S | 1/1991 | Brunner et al. | |
| 5,068,941 | A * | 12/1991 | Dunn | 15/167.1 |
| D355,278 | S | 2/1995 | Dumont | |
| 5,571,140 | A * | 11/1996 | Gura-Emerling | 606/236 |
| 5,636,405 | A | 6/1997 | Stone et al. | |
| 5,826,599 | A | 10/1998 | Adams | |
| 6,105,587 | A | 8/2000 | Dunn | |
| 6,283,751 | B1 | 9/2001 | White | |
| 6,334,231 | B2 * | 1/2002 | Safieh | 15/167.1 |
| D453,378 | S | 2/2002 | Manglone | |
| 6,378,698 | B1 * | 4/2002 | Scoggins | 206/205 |
| D459,808 | S | 7/2002 | Safieh | |
| 6,510,576 | B1 | 1/2003 | Gruber | |
| 6,808,068 | B2 * | 10/2004 | Abada | 206/362.2 |
| D605,406 | S | 12/2009 | Wagner | |
| 2002/0170133 | A1 | 11/2002 | McDevitt et al. | |

FOREIGN PATENT DOCUMENTS

| | | |
|---|---|---|
| CA | 92850 | 6/2001 |
| CN | 201631408 | 11/2010 |
| DE | 10215805 C1 | 8/2003 |
| WO | 9531154 A1 | 11/1995 |

OTHER PUBLICATIONS

American Dental Association, "Oral Health Topics, Teething" Internet, date unknown, www.ada.org.
Wikipedia, the free encyclopedia, "Teething," Internet, date unknown, www.wikipedia.org.
Internet Brands, Inc., The New Parents Guide, "Is My Baby Teething?" date unknown, www.thenewparentsguide.com.
The Mayo Clinic, Infant and Toddler Health, "Teething: Tips for Soothing Sore Gums," date unknown, www.mayoclinic.com/health/teething.

(Continued)

*Primary Examiner* — Randall Chin
(74) *Attorney, Agent, or Firm* — Emerson Thomson Bennett, LLC; Roger D. Emerson; Sergey Vernyuk

(57) ABSTRACT

An infant oral hygiene device comprising a sleeve releasably securable over the finger of a user. The sleeve is generally cylindrical and has first and second ends. The first end receives the finger of the user. The sleeve has one or more openings in its second end. The one or more openings expose a portion of a fabric received over the finger of the user and between the user's finger and the sleeve thereby permitting the fabric to be drawn across the teeth and gums of an infant.

14 Claims, 6 Drawing Sheets

(56) References Cited

OTHER PUBLICATIONS

Ladrillo, T. E., Hobdell, M. H., Caviness, A. C., "Increasing Prevalence of Emergency Department Visits for Pediatric Dental Care, 1997-2001," The Journal of the American Dental Association, Mar. 1, 2006, vol. 137, No. 3, pp. 379-385.

"Finger-Sleeve Brush for Brushing Teeth" Science News Letter, Aug. 28, 1954, p. 135.

Canadian Intellectual Property Office, PCT Written Opinion of the International Searching Authority and International Search Report; May 21, 2013; (10 pages); Quebec, Canada.

* cited by examiner

INFANT ORAL HYGIENE DEVICE

FIELD

This invention relates to oral hygiene devices, and in particular to an oral hygiene and gum stimulating device that may be used on the teeth and gums of infants and small children.

BACKGROUND

The benefits of proper oral hygiene upon the health of an individual's teeth and gums is well known and documented. Over recent years it has been shown that good oral hygiene on the part of infants, babies and small children can be advantageous from the perspective of preventing tooth decay and maintaining healthy gums. The development of good oral hygiene practices and techniques for young children also tends to develop oral hygiene habits that are carried with the child throughout his or her lifetime.

Prior to the emergence of teeth in an infant, gently rubbing, brushing or scrubbing the infant's gums will serve as a means to help dislodge bacteria and help to maintain the health of the gums. Gently rubbing a child's gums will also provide a soothing effect to gums that may become inflamed when a child is teething. When the teeth eventually emerge from the gums into the oral cavity, the enamel surfaces of the teeth will benefit from brushing through the removal of plaque and other debris that may eventually lead to inflamed gums and/or tooth decay.

Traditionally, the teeth and gums of infants and very young children (typically under the age of 1) are cleaned through gently wiping with gauze or a washcloth. When the child is very young wiping the child's gums with gauze or a washcloth can be a difficult task. As the child gets older, and particularly when teeth begin to erupt, children typically become non-cooperative, making the task of cleaning their teeth and gums difficult, if not in some cases next to impossible. An older infant may refuse to open his or her mouth to allow a parent or caregiver access to the teeth and gums, particularly when the child is teething and the gums are sore and inflamed. Some children also exhibit a tendency to bite the finger of a parent or caregiver who is attempting to clean the child's gums.

In an attempt to address the issue of how to effectively clean the teeth and gums of an infant or small child, others have developed a variety of different infant toothbrushes, such as those described under U.S. Pat. Nos. 6,334,231; 5,571,140 and 4,621,387. While such devices are effective to varying degrees, they are in most instances designed for older children and not smaller infants.

SUMMARY

The invention therefore provides an improved infant oral hygiene device that addresses some of the limitations of the prior art.

Accordingly, in one of its aspects the invention provides an infant oral hygiene device comprising a sleeve releasably securable over the finger of a user, said sleeve being generally cylindrical and having first and second ends, said first end receiving the finger of the user, said sleeve having one or more openings in said second end, said one or more openings exposing a portion of a fabric received over the finger of the user and between the user's finger and said sleeve thereby permitting the fabric to be drawn across the teeth and gums of an infant Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

Figure 1:
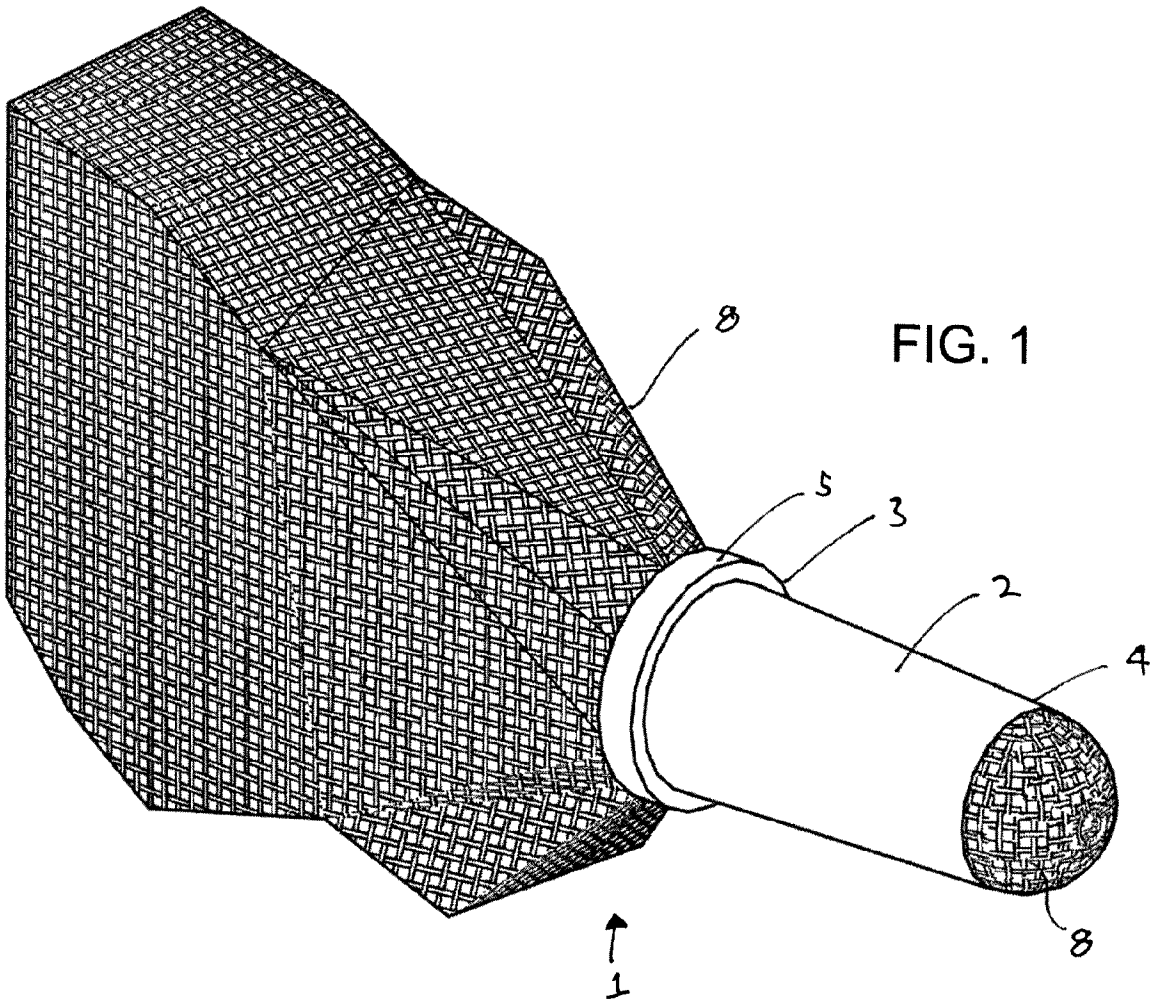
FIG. 1 is an upper side perspective view of one of the preferred embodiments of the infant oral hygiene device of the present invention.

The present invention may be embodied in a number of different forms. The specification and drawings that follow describe and disclose some of the specific forms of the invention.

In the attached Figures there is depicted an infant oral hygiene device constructed in accordance with preferred embodiments of the invention and noted generally by reference numeral 1. Device 1 is comprised of a sleeve 2 that is releasably receivable over the finger of a user. Sleeve 2 is generally in the form of a hollow tubular sleeve having a first end 3 and a second end 4. The sleeve is sized and dimensioned to fit relatively snugly about the finger of an average sized adult, with the adult's finger being inserted into first end 3. The diameter of the sleeve may be consistent along its length or, alternatively, in one of the embodiments of the invention the diameter may decrease slightly when moving from first end 3 to second end 4. Sleeve 2 may also include an enlarged ring member five 5 about first end 3 that allows the sleeve to be grasped and pulled onto the user's finger, and then subsequently grasped and removed from the finger. It will be appreciated that other physical structures aside from ring 5 may equally be utilized to assist in placing the sleeve over a finger and then later removing it.

Figure 6:
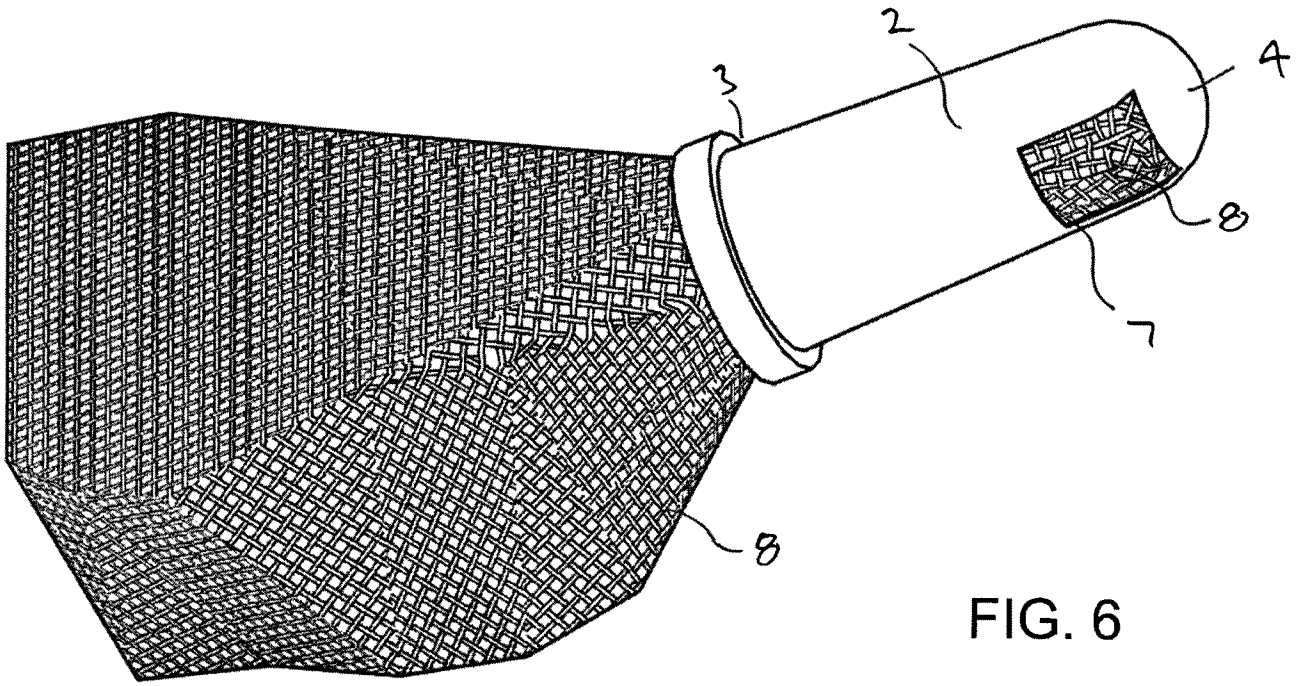
FIG. 6 is a side perspective view of a fourth embodiment of the infant oral hygiene device of the present invention.

As shown in the attached drawings, sleeve 2 preferably includes one or more openings 6 in or about the second end 4. In the embodiment of the invention shown in FIG. 1 opening 6 comprises a completely open end 4 of sleeve 2. Alternately, and for example as shown in FIG. 6, opening 6 may be comprised of a window portion 7 within second end 4, with the remainder of second end 4 being enclosed. It will be understood that further variations of the size, nature, placement and number of openings could equally be utilized. For example, a series of windows 7 could be placed about the circumference of second end 4, or the size and shape of the window or windows could be altered.

Figure 2:
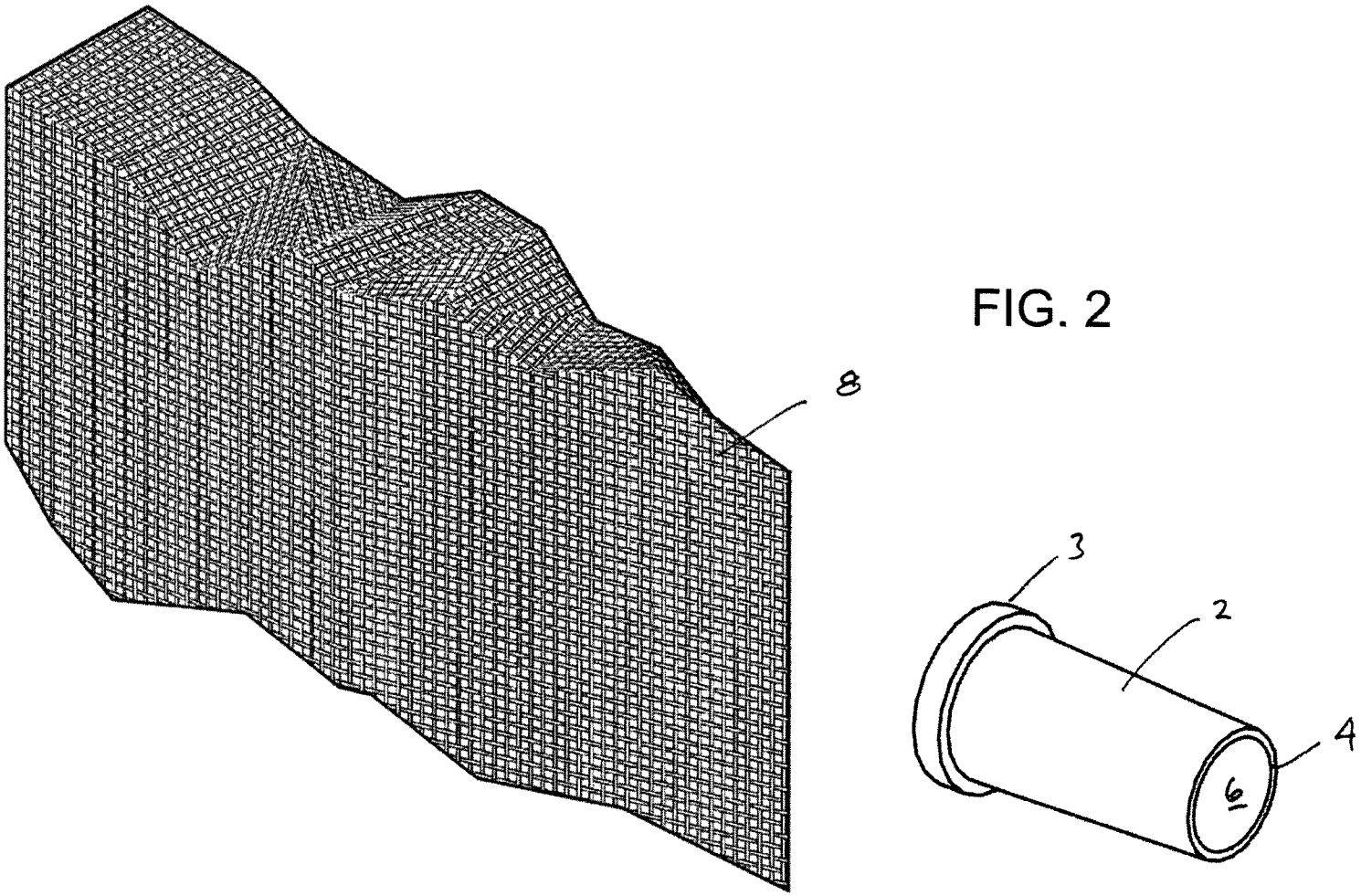
FIG. 2 is a view of the infant oral hygiene device shown in FIG. 1 without having gauze or other fabric inserted therein.
Figure 3:
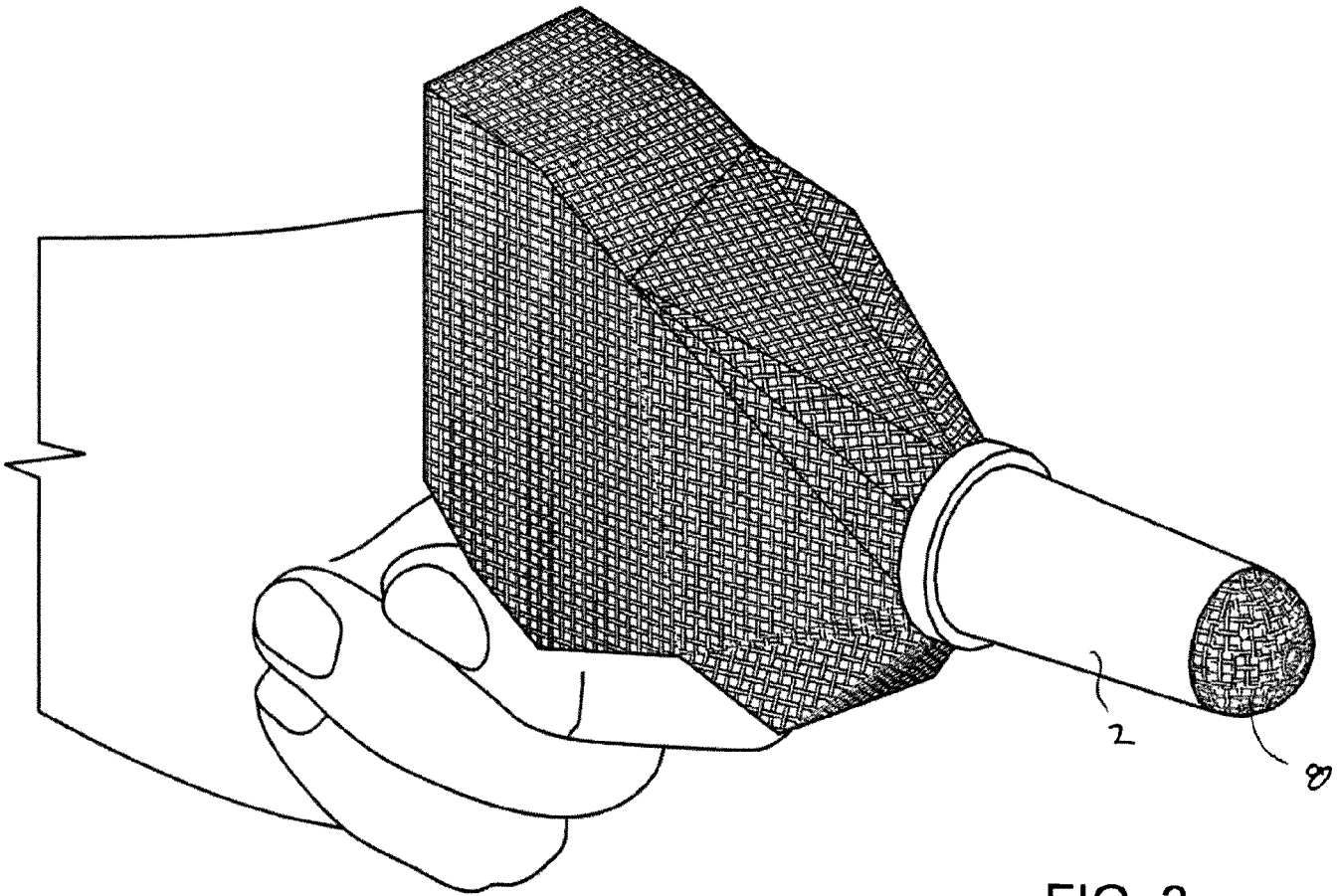
FIG. 3 is a view of the infant oral hygiene device shown in FIG. 1 received over a piece of gauze or fabric and the finger of a user.

Referring to FIGS. 1 through 3, in operation of the invention a fabric 8 is placed over the finger of a user, after which sleeve 2 is slid over the fabric and the finger. The relatively tight fit between the user's finger and sleeve 2 will cause the sleeve to stay in place on the finger and will retain fabric 8 in a taut configuration. At least a portion of fabric 8 is exposed through opening (or openings) 6. In this manner the fabric exposed through opening 6 can be used to wipe or massage the teeth and/or gums of an infant when the user's finger, having sleeve 2 and fabric 8 inserted there over, is inserted into the infant's mouth and slowly drawn across the teeth and gums. The fit of sleeve 2 over the user's finger ensures that the fabric exposed though openings 6 remains taut. Maintaining the fabric in a taut configuration allows the fabric to efficiently clean and massage the teeth and gums, and also helps to present a consistent surface that is less prone to catching upon partially erupted teeth or irritating inflamed gums.

It will be appreciated that sleeve 2 could be formed from a wide variety of different materials. Although the sleeve could be rigid or semi-rigid in nature, it is expected that in most instances the sleeve will be formed from a pliable material, such as rubber, silicone or a similar product. If formed from a rubber or silicone type material the sleeve will also have a degree of flexible resiliency which will enable it to be stretched as it is slid over the finger of a user. In that manner the sleeve may be held more securely about the finger of the user and will be less likely to slide off. The pliable nature of the material from which sleeve 2 may be formed will also tend to be more soothing to the gums of an infant, and will provide a degree of protection to the finger of a user should the infant bite down upon the user's finger.

Figure 4:
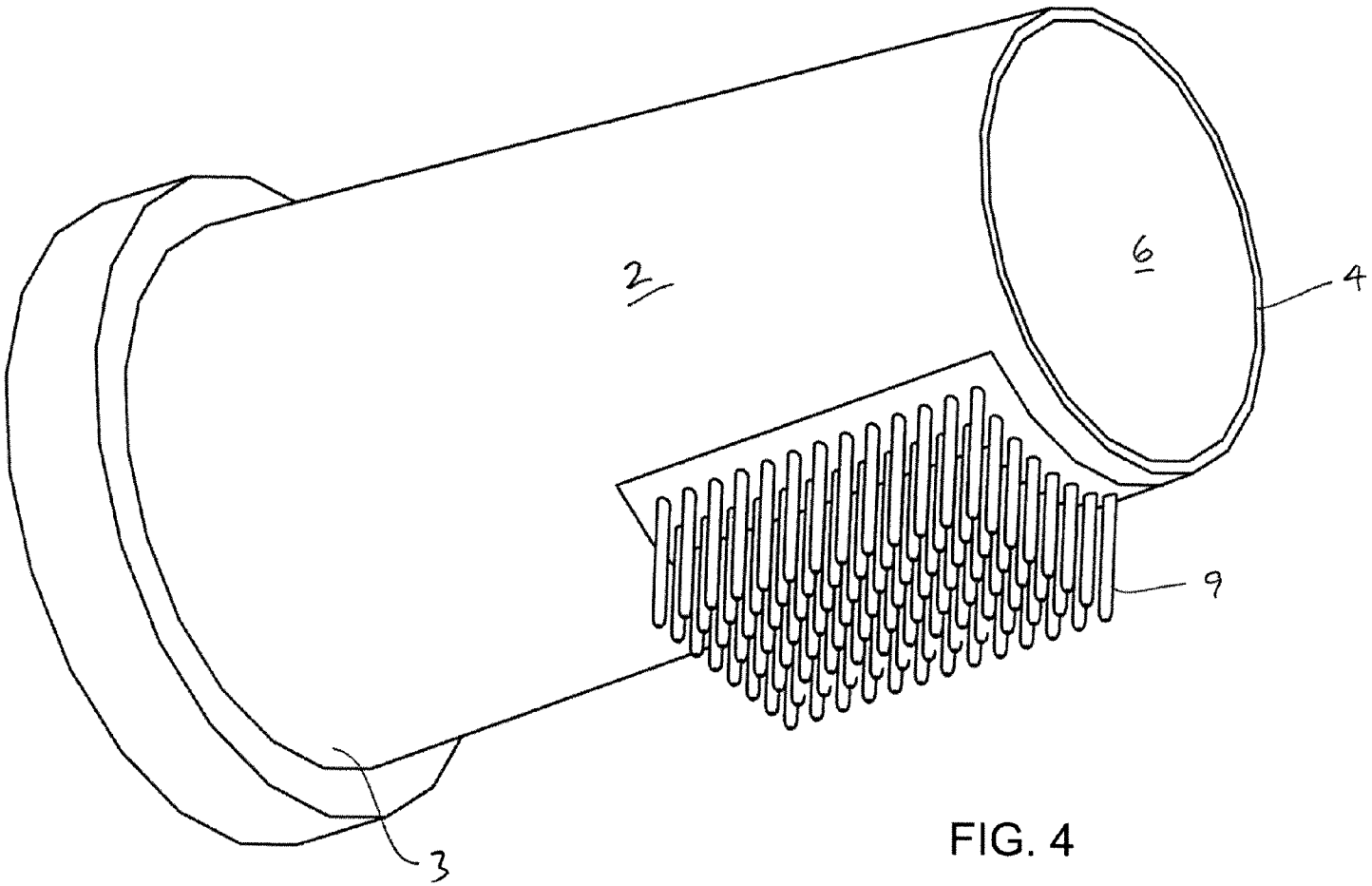
FIG. 4 is a lower side perspective view of a second embodiment of the infant oral hygiene device of the present invention.
Figure 5:
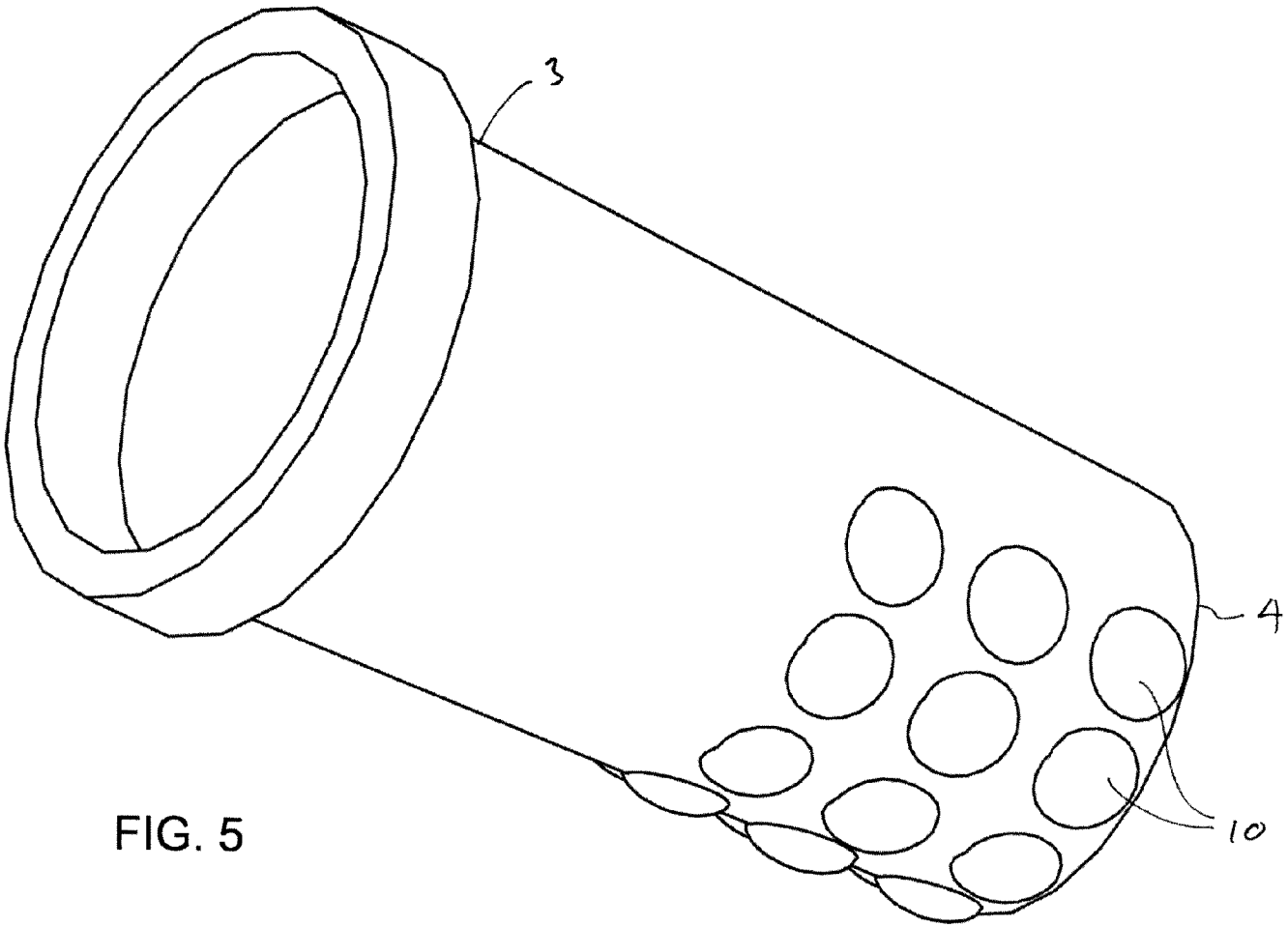
FIG. 5 is a lower perspective view of a third embodiment of the infant oral hygiene device of the present invention.

With reference to FIGS. 4 and 5, in one embodiment of the invention sleeve 2 may be fitted with a plurality of small bristles 9 and/or nibs 10 located on its outer surface at or generally adjacent to second end 4. Bristles 9 or nibs 10 provide the user with a slightly more aggressive means to brush the gums of the infant should there be a significant emersion of teeth that may lend themselves to cleaning more readily through the use of bristles 9 or nibs 10. It will be appreciated that either bristles or nibs could be positioned on the outer surface of sleeve 2, or that in some instances both bristles and nibs could be utilized. It will also be appreciated that the specific location of the bristles and/or nibs on the sleeve could vary.

In the enclosed drawings fabric 8 is shown as comprised of a sheet of gauze. It should, however, be understood that a wide variety of different fabrics or fabric-like materials could equally be used while remaining within the broad scope of the invention. It will also be appreciated by those of ordinary skill in the art and having a thorough knowledge of the invention that although the invention has been described for use as an infant oral hygiene device, it could equally be used by older individuals, particularly those having dentures or having teeth that have been extracted.

It is to be understood that what has been described are the preferred embodiments of the invention. The scope of the claims should not be limited by the preferred embodiments set forth above, but should be given the broadest interpretation consistent with the description as a whole.

I claim:

1. An infant oral hygiene device comprising a sleeve releasably securable over the finger of a user, said sleeve being generally cylindrical and having first and second ends, said first end receiving the finger of the user, said sleeve having one or more openings in said second end, said one or more openings exposing a portion of a fabric received over the finger of the user and between the user's finger and said sleeve thereby permitting the fabric to be drawn across the teeth and gums of an infant.

2. The infant oral hygiene device as claimed in claim 1 wherein said sleeve is constructed from a pliable material.

3. The infant oral hygiene device as claimed in claim 2 wherein said sleeve is formed from silicone or rubber.

4. The infant oral hygiene device as claimed in claim 2 having an open second end, said open second end exposing the tip of the user's finger having the fabric received thereover.

5. The infant oral hygiene device as claimed in claim 1 including a plurality of nibs on its exterior surface.

6. The infant oral hygiene device as claimed in claim 5 having a plurality of bristles on its exterior surface.

7. The infant oral hygiene device as claimed in claim 1 having a plurality of bristles on its exterior surface.

8. The infant oral hygiene device as claimed in claim 1 wherein said second end of said sleeve is enclosed, said one or more openings in said second end comprising one or more window openings to expose the fabric.

9. The infant oral hygiene device as claimed in claim 8 wherein the fabric is gauze.

10. The infant oral hygiene device as claimed in claim 1 wherein the diameter of said sleeve decreases from said first end to said second end.

11. The infant oral hygiene device as claimed in claim 10 including an enlarged ring member on said first end, said ring member facilitating the insertion and removal of said sleeve over the user's finger.

12. The infant oral hygiene device as claimed in claim 11 including a plurality of nibs on its exterior surface.

13. The infant oral hygiene device as claimed in claim 12 having a plurality of bristles on its exterior surface.

14. The infant oral hygiene device as claimed in claim 11 having a plurality of bristles on its exterior surface.

* * * * *